US009876299B2

(12) United States Patent
Liao et al.

(10) Patent No.: US 9,876,299 B2
(45) Date of Patent: Jan. 23, 2018

(54) ELECTRICAL CONNECTOR ASSEMBLY WITH FLOATING SUPPORT

(71) Applicant: FOXCONN INTERCONNECT TECHNOLOGY LIMITED, Grand Cayman (KY)

(72) Inventors: Fang-Jwu Liao, New Taipei (TW); Po-Yuan Su, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/402,143

(22) Filed: Jan. 9, 2017

(65) Prior Publication Data

US 2017/0201035 A1 Jul. 13, 2017

(30) Foreign Application Priority Data

Jan. 8, 2016 (CN) ..... 2016 2 0014739 U

(51) Int. Cl.
*H01R 12/79* (2011.01)
*H01R 12/71* (2011.01)
*H01R 12/62* (2011.01)

(52) U.S. Cl.
CPC ..... *H01R 12/79* (2013.01); *H01R 12/62* (2013.01); *H01R 12/712* (2013.01)

(58) Field of Classification Search
CPC .. H01R 12/774; H01R 12/775; H01R 12/777; H01R 12/778; H01R 12/78; H01R 12/79; H01R 12/77; H01R 12/771
See application file for complete search history.

(56) References Cited

U.S. PATENT DOCUMENTS 5,383,787 A * 1/1995 Switky ..... H01L 23/32 439/67
5,859,538 A * 1/1999 Self ..... G01R 31/2886 324/754.07
6,144,559 A * 11/2000 Johnson ..... G01R 1/0416 174/255
6,347,946 B1 * 2/2002 Trobough ..... G01R 1/0416 361/790
6,425,768 B1 * 7/2002 Taylor ..... H01R 4/5008 439/331

(Continued)

FOREIGN PATENT DOCUMENTS

CN 202042681 U 11/2011

*Primary Examiner* — Ross Gushi
(74) *Attorney, Agent, or Firm* — Wei Te Chung; Ming Chieh Chang

(57) ABSTRACT

The electrical connector assembly includes an insulative housing and a plurality of contacts retained in the housing. The stand includes a support and a spring supporting the support. The electrical connector is seated upon the support and moveable along with the support in the vertical direction due to deformation of the spring. Each of the contacts includes an upper contacting section and a lower contacting section. An electronic component located upon the housing and downwardly pressing and mechanically and electrically connected to the upper contacting sections. An FPC is sandwiched between the support and the electrical connector and mechanically and electrically connected to the lower contacting sections.

20 Claims, 8 Drawing Sheets

(56) References Cited

U.S. PATENT DOCUMENTS 6,634,890 B2 * 10/2003 Peterson ..... H01R 12/82 439/67
6,926,537 B1 * 8/2005 Auchincloss ..... H01R 12/62 439/67
6,971,887 B1 * 12/2005 Trobough ..... H05K 7/1092 439/71
7,153,144 B2 * 12/2006 Ohsawa ..... H01R 12/62 439/67
7,244,137 B2 * 7/2007 Renfro ..... H01R 13/193 439/342
7,248,036 B2 * 7/2007 Trobough ..... G01R 31/31905 324/754.09
7,248,481 B2 * 7/2007 Trobough ..... H05K 7/1061 361/785
7,407,408 B1 * 8/2008 Taylor ..... H01R 23/661 439/449
7,411,282 B2 * 8/2008 Furuyama ..... G02B 6/4201 257/678
7,489,514 B2 * 2/2009 Hamasaki ..... G02B 6/3817 361/721
7,517,228 B2 * 4/2009 Baskaran ..... H05K 1/147 439/67
7,611,924 B2 * 11/2009 Kim ..... H01L 23/49833 257/E21.499
7,667,311 B2 * 2/2010 Furuyama ..... G02B 6/4201 257/678
7,753,692 B2 * 7/2010 Hsu ..... H01R 12/714 439/70
7,989,946 B2 * 8/2011 Braunisch ..... H01L 23/66 257/691
8,123,541 B2 * 2/2012 Hsu ..... H01R 12/716 439/325
8,188,594 B2 * 5/2012 Ganesan ..... H01L 23/367 257/675
8,353,708 B2 * 1/2013 Hsu ..... H05K 7/1007 439/67
8,450,201 B2 * 5/2013 Braunisch ..... H01L 23/66 257/693
8,708,729 B2 * 4/2014 An ..... H01R 12/79 439/331
8,758,036 B2 * 6/2014 An ..... H01R 12/79 439/331
8,867,231 B2 * 10/2014 Roitberg ..... H01L 23/50 361/729
9,209,537 B2 * 12/2015 Hsu ..... H01R 12/7029
9,252,521 B1 * 2/2016 Beaman ..... H01R 12/718
9,265,170 B2 * 2/2016 Swaminathan ..... H01R 12/716
9,425,528 B2 * 8/2016 Tsubo ..... H01R 12/772
9,484,649 B2 * 11/2016 Beaman ..... H01R 12/73
9,490,560 B2 * 11/2016 Chawla ..... H05K 7/1069
9,590,338 B1 * 3/2017 Schmitt ..... H01R 12/714
2005/0264277 A1 * 12/2005 Trobough ..... G01R 31/31905 324/754.09
2006/0035510 A1 * 2/2006 Numata ..... G02B 6/43 439/372
2011/0287639 A1 * 11/2011 Hsu ..... H05K 7/1007 439/68
2014/0268577 A1 * 9/2014 Swaminathan ..... H05K 1/0204 361/719

* cited by examiner

ELECTRICAL CONNECTOR ASSEMBLY WITH FLOATING SUPPORT

BACKGROUND OF THE INVENTION

1. Field of the Invention

The present invention relates to an electrical connector and the support, and particularly to the support moveable in a floating manner in a vertical direction.

2. Description of Related Art

Chinese Patent No. CN202042681 discloses an electrical connector assembly having a first connector receiving the CPU (Central Processing Unit), and a second connector attached upon the first connector and mechanically and electrically connected to one side/top region of the CPU for further connecting to other electronic parts via an FPC (Flexible Printed Circuit). Anyhow, such an approach improperly increases the height of the whole CPU/connector assembly, thus contradicting the lower profile/miniaturization trend. U.S. Pat. No. 9,130,322 discloses another approach using an adaptor structure cooperation with or located between other two upper and lower connectors for mounting to a top/side region of the CPU board. Anyhow, such arrangement requires the contacts of the lower connector soldered to the CPU board and the contacts of the upper connector soldered to the FPC, thus increasing complexity thereof. Yet another approach is to use a discrete connector side by side arranged with the CPU socket to have a side region of the CPU downwardly abut against the discrete connector for connecting to the FPC. Anyhow, there is a potential risk for poor connection between the CPU and the FPC due to the different heights between CPU socket and the discrete housing.

An improved connector which is located beside the CPU socket with an adjustable effect to comply with the CPU socket having variable heights thereof, thus assuring reliable connection among the CPU, the contacts of the discrete connector and the FPC so as to achieve the superior transmission from the CPU to the FPC. The adjustment of the electrical connector simultaneously reinforces confrontation between the electrical connector and the FPC so that it is unnecessary to have the contacts of the electrical connector soldered upon the FPC but through a clipping/pressing effect via the spring effect.

SUMMARY OF THE INVENTION

An electrical connector assembly an electrical connector and a stand which the connector is seated. The electrical connector includes an insulative housing and a plurality of contacts retained in the housing. The stand includes a support and a spring supporting the support. The electrical connector is seated upon the support and moveable along with the support in the vertical direction due to deformation of the spring. Notably, the moveability of the connector provides adjustability of the whole connector assembly to comply with the CPU mounted upon a CPU socket which is essentially side by side arranged with the electrical connector assembly.

Other objects, advantages and novel features of the invention will become more apparent from the following detailed description when taken in conjunction with the accompanying drawings.

DETAILED DESCRIPTION OF THE PREFERRED EMBODIMENT

Figure 1:
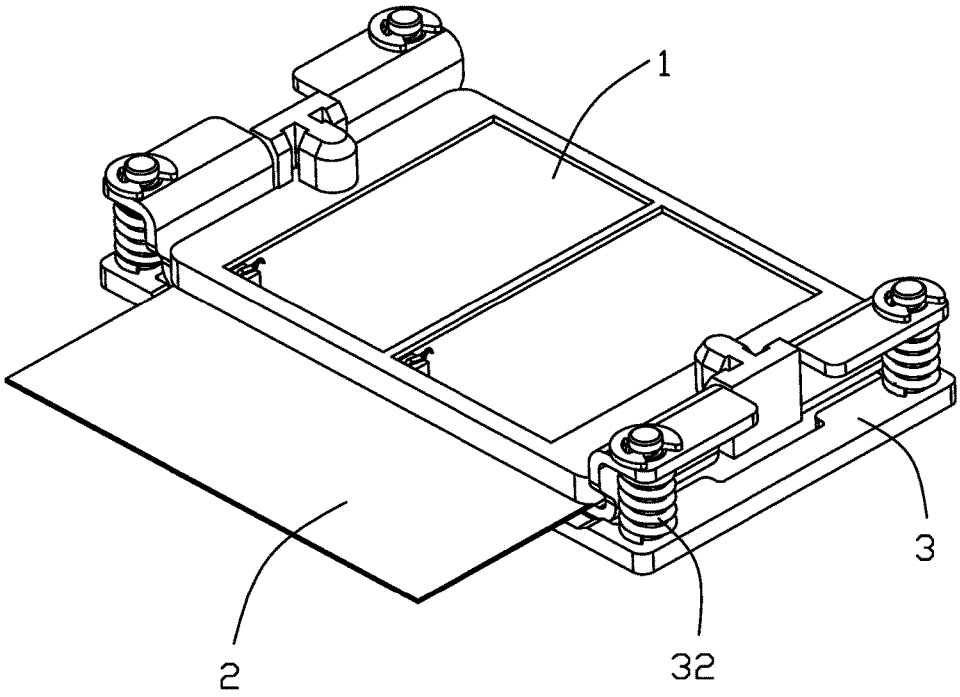
FIG. 1 is an assembled perspective view of an electrical connector assembly according to the presently preferred embodiment of the invention.
Figure 2:
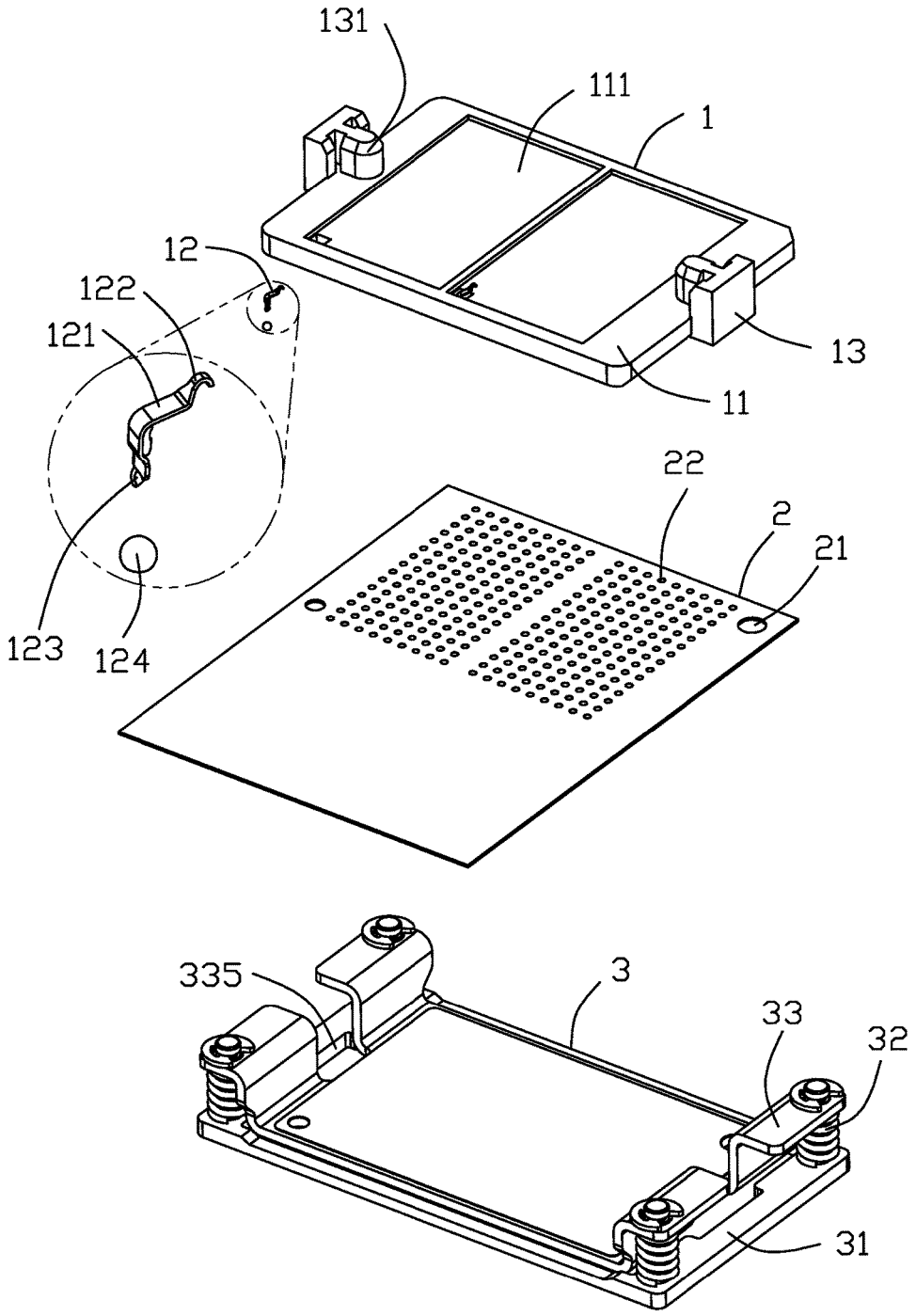
FIG. 2 is a downwardly exploded perspective view of the electrical connector assembly of FIG. 1.
Figure 3:
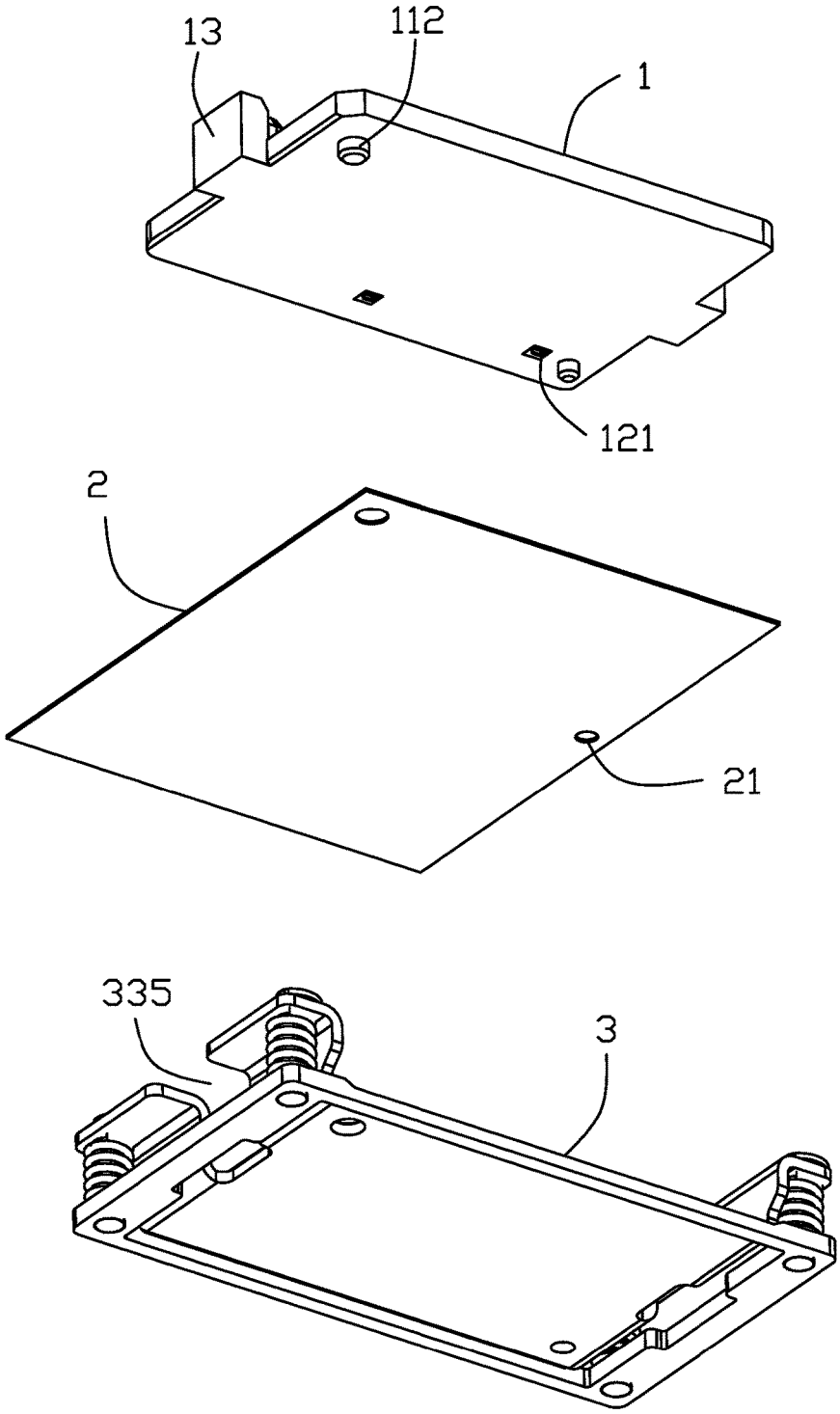
FIG. 3 is an upwardly exploded perspective view of the electrical connector assembly of FIG. 1.
Figure 4:
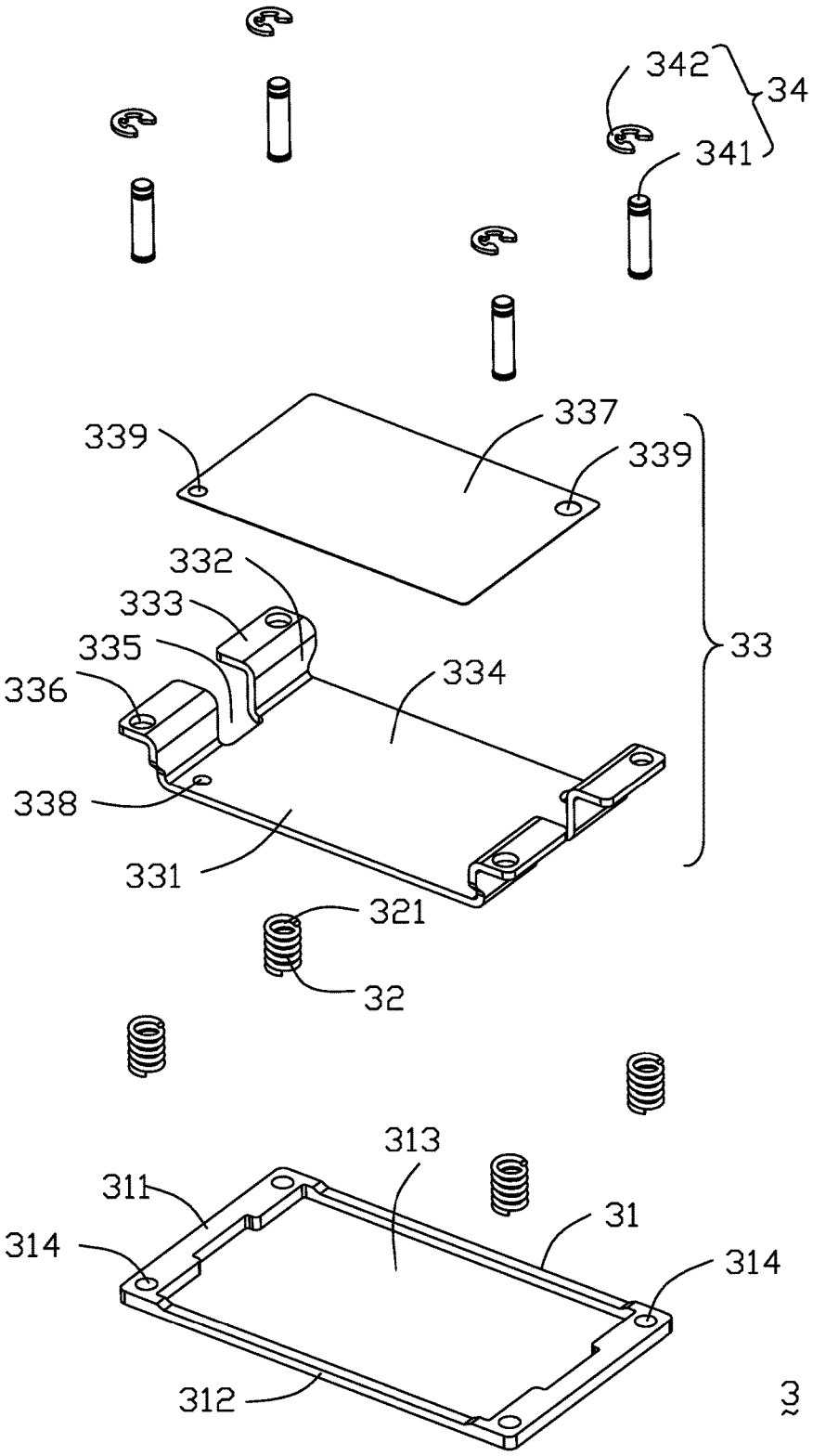
FIG. 4 is an exploded perspective view of the stand of the electrical connector assembly of FIG. 1.

Reference will now be made in detail to the preferred embodiment of the present invention.

Referring to FIGS. 1-8, an electrical connector assembly includes an electrical connector 1, an FPC 2, i.e., the flexible printed circuit (board), and a stand 3 wherein the FPC is essentially sandwiched between the electrical connector 1 and the stand 3 in the vertical direction.

The electrical connector 1 includes an insulative housing 11 and a plurality of contacts 12 (only two shown as representatives) retained in the housing 11. The housing includes opposite top and bottom faces wherein the top face forms a receiving cavity 111 to receive a corresponding extension 502 of the CPU 500. The housing 11 is rectangular and includes a first fixing part 13 with a guiding section 131 facing the receiving cavity 111 to be received in a notch 504 of the CPU 500 for guiding the corresponding extension 502 of the CPU 500 into the receiving cavity 111. A pair of alignment posts 112 downwardly extend from two opposite diagonal corners of the housing 11. The contact 12 includes a main body 121, an upper contacting section 122, a lower contacting section 123 and a solder ball 24 attached to the lower contacting section 123. Notably, the solder ball 124 may not be necessary if the lower contacting section 123 is shaped as the upper contacting section 122 for resiliently contacting the counterpart.

The FPC 2 includes an alignment holes 21 through which the corresponding alignment posts 112 respectively extend, and a plurality of conductive pads 22. In this embodiment, because the lower contacting section 123 is equipped with the solder ball 124, the conductive pads 22 are soldered with the solder ball 124. Anyhow, in an alternate embodiment the conductive pad 22 may be directly pressed by the resilient lower contacting section 123 for mechanical and electrical connection therebetween.

The stand 3 includes a base 31, a support 33, a spring 32 sandwiched therebetween in the vertical direction for supporting the support 33, a fixer 34 fixing the base 31, the support 33 and the spring 32 together. The base 31 is a rectangular frame, including opposite lengthwise end sections 311 and opposite sides 312 linked between the lengthwise end sections 311, and an opening 313 surrounded by the lengthwise end sections 311 and sides 312. A pair of first fixing holes 314 are formed in each corresponding lengthwise end section 311.

The support 33 is metallic and includes a main plate 331, a pair of connection sections 332 upward extending from two opposite lengthwise ends of the mating plate 331, and a pair of mounting sections 333 extending from the corresponding connection sections 332 outwardly wherein the main plate 331 and the connection sections 332 commonly form a receiving space 334 to receive the electrical connector 1. The connection section 332 forms a second fixing part 335 to receive the first fixing part 13 of the electrical connector 1 therein. Each mounting section 333 forms a pair of corresponding second fixing holes 336 aligned with the corresponding first fixing holes 314, respectively, in the vertical direction. The support 33 further includes an insulative plate 337 which is rectangular and located between the FPC 2 and the main plate 331 in the vertical direction for preventing shorting between the FPC 2 and the main plate 331. The main plate 331 has a pair of alignment apertures 338 and the insulative plate 337 has a pair of alignment orifices 339 so that the alignment posts 112 of the electrical connector 1 extends through the corresponding alignment holes 21 of the FPC 2, the corresponding alignment orifices 339 of the insulative plate 337, and the corresponding alignment apertures 338 of the main plate 331 to prevent relative transverse movements among the electrical connector 1, the FPC 2, the insulative plate 337 and the support 33.

The springs 32 are sandwiched between the mounting sections 333 and the lengthwise end sections 311 in the vertical direction. The spring 32 forms a through hole 321. The fixer 34 includes a fixing pin 341 and the stopper 342 wherein the fixing pin 341 extends through the corresponding second fixing hole 336 and the corresponding through hole 321, and is retainably terminated within the corresponding first fixing hole 314 with the stopper 342, i.e., the C-ring, secured to the retaining groove (not labeled) of the top end of the fixing pin 341 to have the support 33, the springs 32 and the base 31 secured together wherein the support 33 is moveable in the vertical direction with regard to the base 31 in a floating/tensioned manner.

Figure 5:
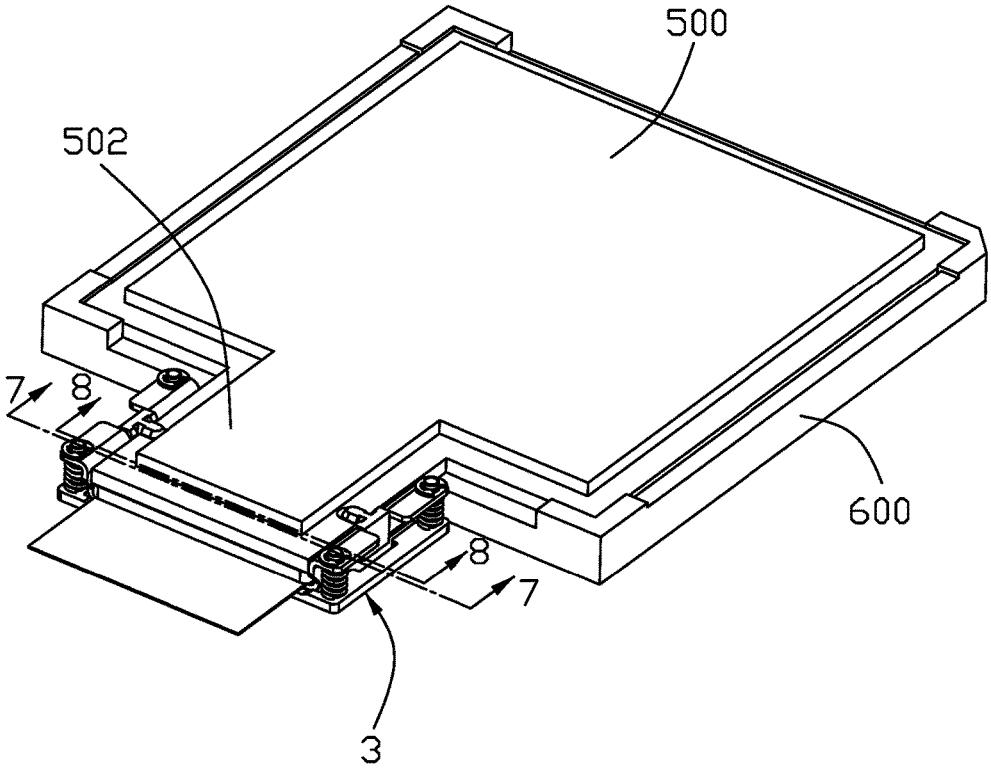
FIG. 5 is an assembled perspective view of the electrical connector assembly of FIG. 1 to use with a CPU socket with the CPU thereon wherein the CPU downwardly presses the electrical connector and the associated contacts.
Figure 6:
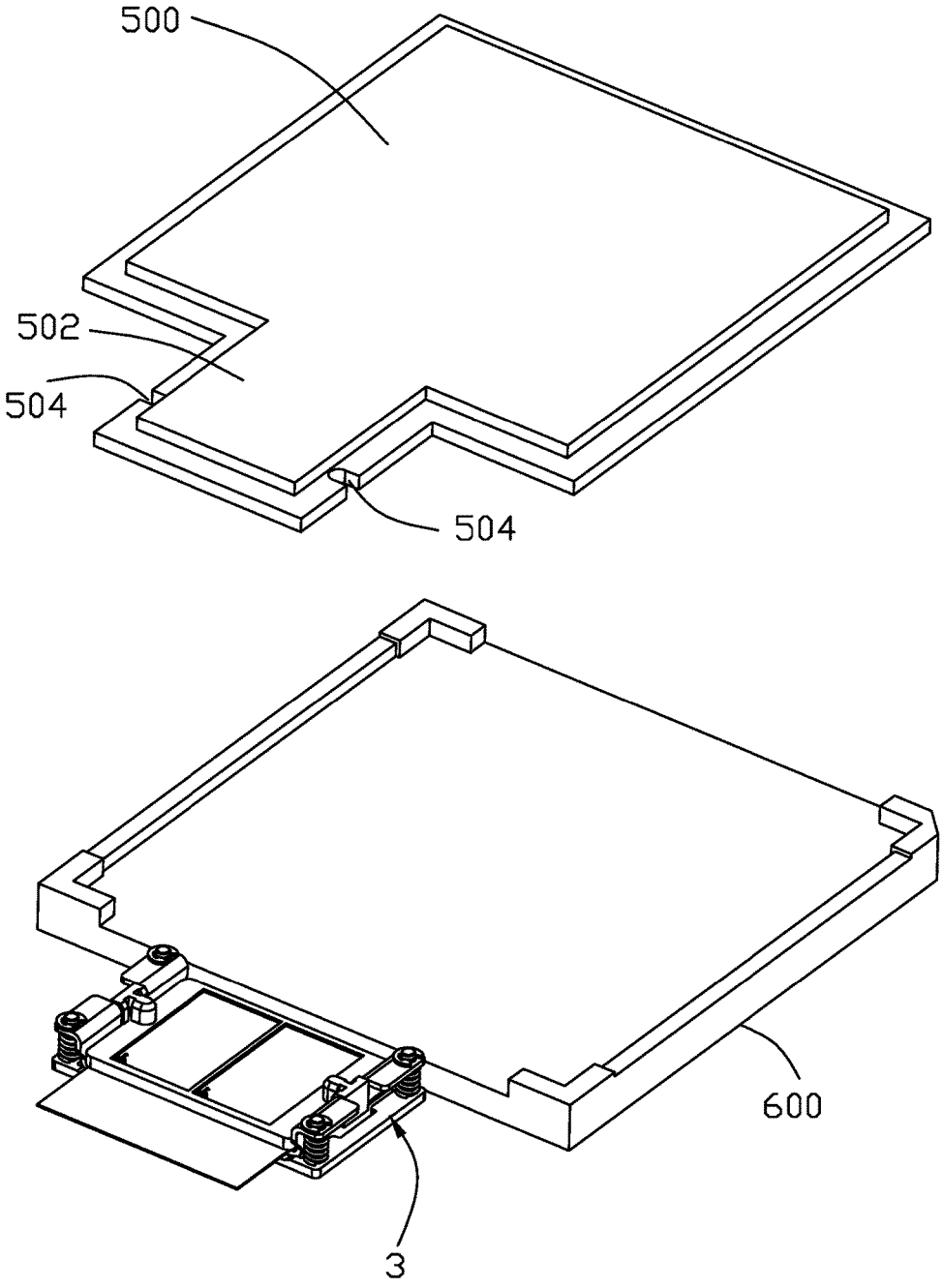
FIG. 6 is an exploded perspective view of electrical connector assembly of FIG. 5 with the CPU removed away from the CPU socket.
Figure 7:
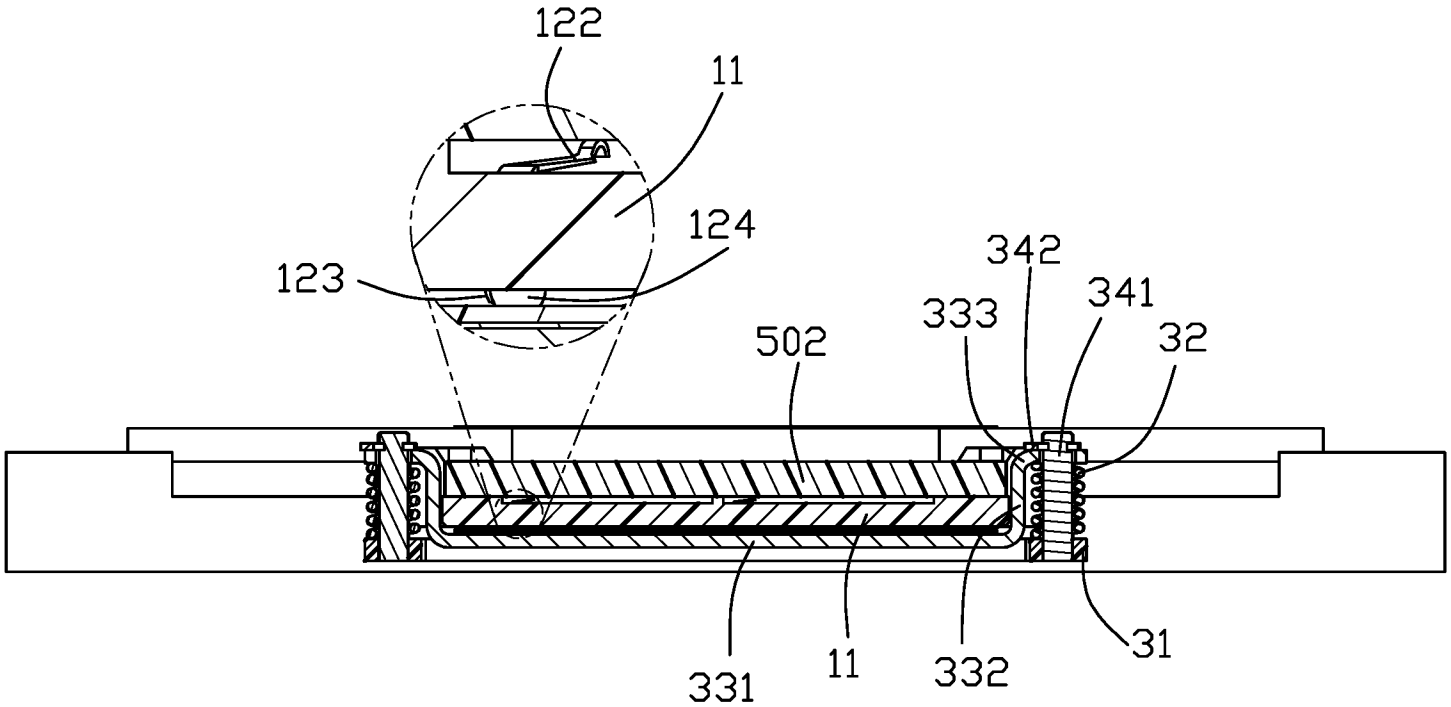
FIG. 7 is a cross-sectional view of the electrical connector assembly and the CPU socket with the associated CPU of FIG. 5, taken along a transverse line passing through the fixing hole.
Figure 8:
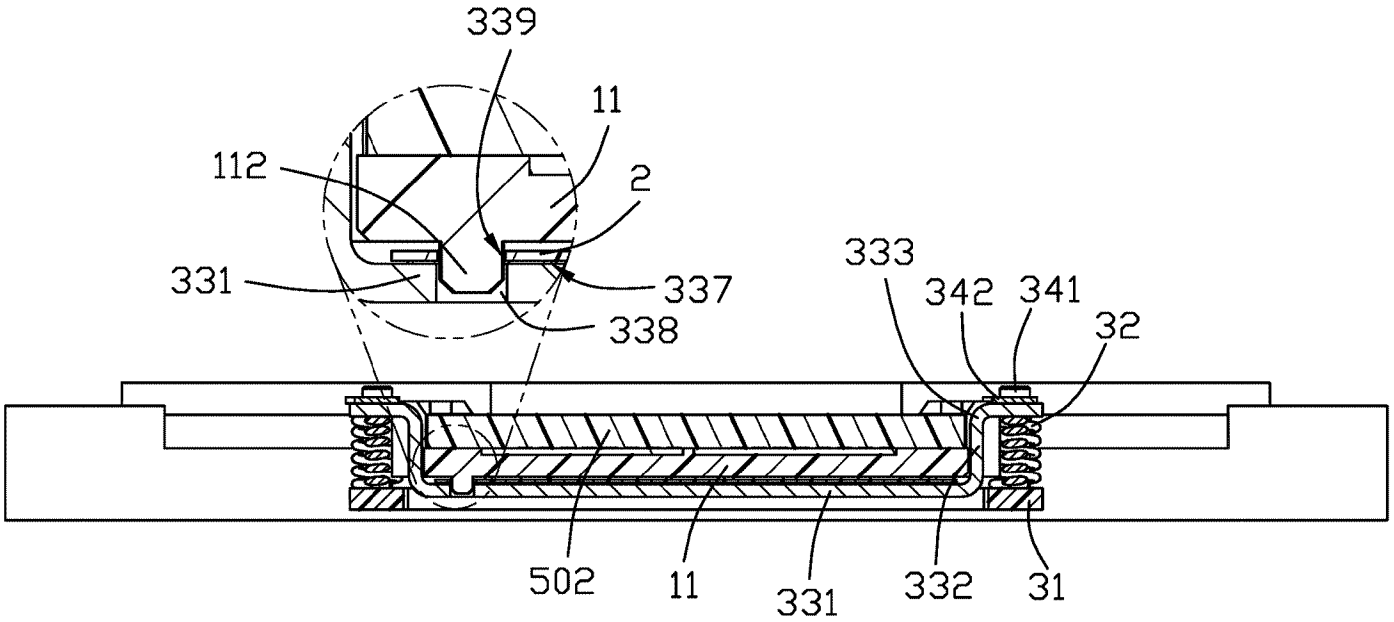
FIG. 8 is a cross-sectional view of the electrical connector assembly and the CPU socket with the associate CPU of FIG. 5, taken along another transverse line passing through the alignment hole.

As shown in FIGS. 5 and 6, in this embodiment, the CPU socket 600 is side by side arranged with the electrical connector 1 wherein the CPU 500 includes a main portion coupling to the corresponding contacts (not shown) of the CUP socket 600 and the aforementioned extension 502 extends horizontally and received within the electrical connector 1 to mate with the corresponding contacts 12. Understandably, the main portion of the CPU 500 is downwardly forced by some clipping device (not shown) on the CPU socket 600. Under such a situation, the extension 502 downwardly presses the electrical connector 1 so as to cooperate with the support 33 to directly press the FPC 2 which endures an upward force from the support 33 due to the spring 32.

Notably, in this embodiment the electrical connector 1 is detachably mounted upon the stand 3 via the alignment post 112 and the first fixing part 13. The insulative housing 11 of the electrical connector 1 is supported upwardly by the support 33 in a floating manner due to the springs 32 so as to efficiently forgive/compromise the height difference between the CPU 500 and the electrical connector 1, thus assuring the reliable mechanical and electrical connection between the electrical connector 1 and the CPU 500 without risks of either the poor connection due to the insufficient contacting force between the CPU 500 and the electrical connector 1 or the structural damage due to the excessive force between the CPU 500 and the electrical connector 1. Furthermore, because the spring 32 provides an additional upward force upon the FPC 500, the mechanical connection between the contacts 12 and the conductive pads 22 may no longer require the solder ball 124 but only with the resilient lower contacting section 124 alternately.

Understandably, the fixing pin 341 may be replaced with a screw and the stopper 342 may be replaced with a screw nut so that the maximum/highest position of the support 33 relative to the base 31 is controllably adjustable in the vertical direction for efficiently complying with the height of the CPU 500 which is corresponding to the height of the CPU socket 600.

However, the disclosure is illustrative only, changes may be made in detail, especially in matter of shape, size, and arrangement of sections within the principles of the invention.

What is claimed is:

1. An electrical connector assembly comprising:

an electrical connector including:

an insulative housing;

a plurality of contacts disposed in the housing, each of said contacts having an upper contacting section and a lower contacting section;

a stand located below the housing and including a support, on which the connector is seated, moveable in a floating manner along a vertical direction; and a flexible printed circuit (FPC) sandwiched between the electrical connector and the support in the vertical direction; wherein the lower contacting section of each of said contacts is mechanically and electrically connected to the FPC; wherein said housing is detachably assembled upon the support.

2. The electrical connector assembly as claimed in claim 1, further including a socket located beside the housing and an electronic component disposed in the socket with an extension extending transversely to be located upon the housing and downwardly press the upper contacting sections of the contacts whereby the FPC and the electronic component are electrically connected to each other through said electrical connector.

3. The electrical connector assembly as claimed in claim 2, wherein a first direction along which the FPC extends, is same with a second direction along which the extension extends.

4. The electrical connector assembly as claimed in claim 1, wherein the lower connecting section of each of said contacts is electrically connected to the FPC via a solder ball attached thereto.

5. The electrical connector assembly as claimed in claim 1, wherein the stand further includes a base spaced from the support with springs therebetween to provide said floating manner.

6. The electrical connector assembly as claimed in claim 5, wherein the stand defines four corners of which each is equipped with one spring.

7. The electrical connector assembly as claimed in claim 5, wherein the base and the support defines respective fixing holes, and said stand further includes fixing pins extending through said fixing holes with the springs respectively surrounding the corresponding fixing pins.

8. The electrical connector assembly as claimed in claim 1, further including means for assuring that assembling the electrical connector upon the support is implemented along the vertical direction.

9. The electrical connector assembly as claimed in claim 1, wherein the support and the FPC define corresponding alignment holes, and the housing defines corresponding alignment posts through said alignment holes sequentially.

10. An electrical connector assembly comprising:

an electrical socket;

an electrical connector located beside the socket in a direction, and including an insulative housing with a plurality of contacts therein, each of said contacts including an upper contacting section and a lower contacting section;

an electronic component disposed upon the socket and having an extension along said direction, said extension downwardly pressing and mechanically and electrically connected to the corresponding upper contacting sections; and a flexible printed circuit (FPC) mechanically and electrically connected to the lower contacting sections; wherein said FPC is moveable along a vertical direction in a floating manner;

further including a stand having a rigid support on which the housing is attached wherein said support is moved along with the electrical connector in said floating manner.

11. The electrical connector assembly as claimed in claim 10, wherein said FPC extends along the same direction.

12. The electrical connector assembly as claimed in claim 10, wherein said FPC defines alignment holes and the housing defines alignment post extending through said alignment holes, respectively.

13. The electrical connector assembly as claimed in claim 10 wherein said stand is equipped with springs to result in said floating manner.

14. The electrical connector assembly as claimed in claim 10, wherein said housing is detachably mounted upon the support.

15. The electrical connector assembly as claimed in claim 10, wherein said FPC is connected to the corresponding lower contacting section via a solder ball attached upon said corresponding lower contacting section.

16. The electrical connector assembly as claimed in claim 10, wherein said support is metallic.

17. The electrical connector assembly as claimed in claim 10, wherein said stand further includes a base with springs compressible between the base and the support.

18. An electrical connector assembly comprising:

an electrical socket;

an electrical connector located beside the socket and including an insulative housing with a plurality of contacts therein, each of said contacts including an upper contacting section and a lower contacting section;

an electronic component having a main portion with an extension along a direction from said main portion, said extension downwardly pressing and mechanically and electrically connected to the corresponding upper contacting sections; and a flexible printed circuit (FPC) mechanically and electrically connected to the lower contacting sections and extending along said same direction; wherein said FPC is moveable along a vertical direction in a floating manner;

further including a stand with a rigid support on which the housing is attached wherein said support is moved along with said FPC in said floating manner.

19. The electrical connector assembly as claimed in claim 18, wherein said stand further includes a base with springs compressible between the base and the support.

20. The electrical connector assembly as claimed in claim 18, wherein said support is metallic.

* * * * *